United States Patent [19]

Nolan

[11] 4,170,303

[45] Oct. 9, 1979

[54] COMBINATION TRAY AND PICTURE FRAME APPARATUS

[76] Inventor: Ronald M. Nolan, 5739 Roanwood Way, Concord, Calif. 94521

[21] Appl. No.: 845,321

[22] Filed: Oct. 25, 1977

Related U.S. Application Data

[63] Continuation-in-part of Ser. No. 710,782, Aug. 2, 1976, Pat. No. 4,094,085.

[51] Int. Cl.[2] ..... B65D 1/34

[52] U.S. Cl. ..... 206/557; 206/562; 224/48 R

[58] Field of Search ..... 206/562, 557, 556, 456, 206/561, 459; 224/48 R

[56] References Cited

U.S. PATENT DOCUMENTS

| | | | |
|---|---|---|---|
| 1,962,556 | 6/1934 | Eberhardt, Jr. | 224/48 R |
| 2,047,835 | 7/1936 | Prew | 224/48 R |
| 2,469,530 | 5/1949 | Thompson | 206/557 |
| 2,627,344 | 2/1953 | Prestinari | 206/561 |
| 2,633,980 | 4/1953 | Jorgensen | 206/456 |
| 2,968,882 | 1/1961 | Ozeki | 206/456 |
| 3,365,056 | 1/1968 | Mandel | 206/459 |
| 3,851,808 | 12/1974 | Schilling | 206/557 |

*Primary Examiner*—William T. Dixson, Jr.
*Attorney, Agent, or Firm*—Phillips, Moore, Weissenberger, Lempio & Majestic

[57] ABSTRACT

A tray convertable to a picture frame designed specifically for the display of a plurality of baseball cards, photographs, or the like is disclosed. Included is a frame portion including top, bottom, and side struts and one or more vertical and horizontal struts, such that window openings are defined within the frame portion thereby. Inserts are removably or permanently formed in one or more said window openings by means for affixing said inserts to adjacent struts. Elongated slots are further defined for each window opening so that a card or the like can be seated therein in front of said inserts, or when said inserts have been removed.

10 Claims, 7 Drawing Figures

COMBINATION TRAY AND PICTURE FRAME APPARATUS

CROSS-REFERENCE TO RELATED APPLICATION

This is a continuation-in-part of application Ser. No. 710,782, filed on Aug. 2, 1976 U.S. Pat. No. 4,094,085.

BACKGROUND OF THE INVENTION

Picture frames having a plurality of viewing areas or window openings are well known in the art. However, a means for inexpensively converting a tray into a picture frame having a unique means for displaying cards or the like, is not known to the applicant. Such an apparatus would have utility, for example, in a fast food restaurant, wherein such an apparatus could be used as a promotional item, usable first to carry foods and drinks to a table, and later usable by the consumer as a picture frame. It could also be used initially as a packaging tray for a separate product.

SUMMARY OF THE INVENTION

The present invention is a combination tray and picture frame apparatus wherein the picture frame disclosed in the prior copending application Ser. No. 710,782 is improved in that it is further initially usable as a tray. An insert means is provided, wherein one or more inserts are formed, one each in each window opening defined by the picture frame. These inserts may be removably formed in a connected relationship to struts defined in the picture frame by means of attachment means comprising one or more nipples connecting the insert to adjacent struts. The inserts may also be permanently formed as part of adjacent struts. The picture frame including the inserts can be formed inexpensively from a single piece of molded plastic.

Therefore, a principle object of the present invention is to produce an inexpensive yet sturdy combination tray and picture frame apparatus for use initially as a tray, and for subsequent use as an apparatus for displaying a plurality of baseball cards or the like.

A further object of the present invention is to provide inserts with depressions defined therein for enabling cups to be carried on the tray with a minimum danger of spillage.

Another object of the present invention is to provide a means for enabling the easy removal of the insert formed in each said window opening of the picture frame apparatus.

These and other objects of the present invention will become more readily apparent upon reference to the accompanying drawings and following description.

DESCRIPTION OF THE PREFERRED EMBODIMENT

Figure 1:
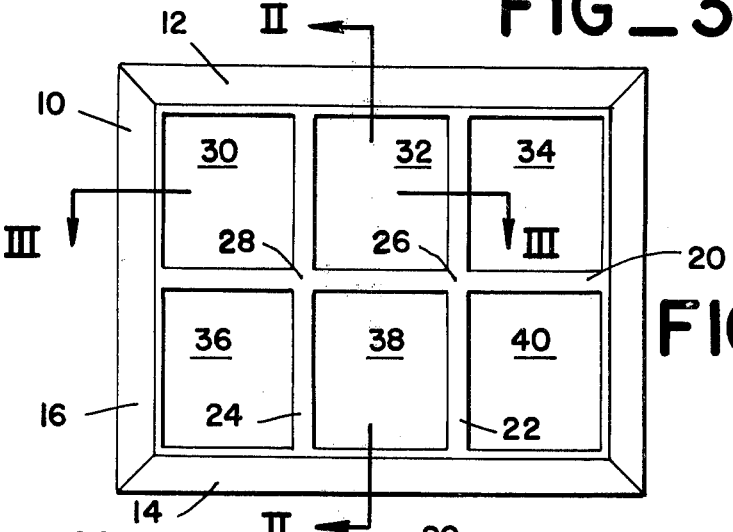
FIG. 1 illustrates the front view of a picture frame apparatus for use according to the present invention.

The front view of a picture frame apparatus according to the present invention is shown in FIG. 1. The picture frame apparatus may be formed as a unitary piece of molded plastic having a thickness of 3/32". The plastic used can be any inexpensive thermoplastic or thermosetting plastic available. The apparatus includes a frame portion 10 comprising a top edge strut 12, a bottom edge strut 14 and first and second side struts 16 and 18. The picture frame apparatus also includes strut means comprising at least one strut interconnecting two of said edge struts, 12, 14 and 16, 18, such that a plurality of window openings are defined within said frame portion thereby. FIG. 1 illustrates a frame apparatus having one horizontal strut 20 and two equally-spaced apart vertical struts 22 and 24. The preferred embodiment is to have the horizontal struts 20 oriented parallel to the top edge and bottom edge struts 12, 14, and the vertical struts 22, 24 oriented parallel to the first and second side struts 16, 18. Note that the vertical and horizontal struts join each other at cross points 26 and 28 formed therefrom.

The struts of FIG. 1 define six window openings, 30, 32, 34, 36, 38, and 40. Note that more or less vertical and horizontal struts can be provided to increase or decrease the plurality of window openings as desired. The apparatus of the present invention contemplates having any plurality of window openings from a minimum of two on up. Further, each window opening is envisioned as being of substantially identical size so that cards or the like having the same size will be insertable in any of said window openings. Also, one frame apparatus could have openings sized for cards, and a second frame have openings sized for photographs.

Figure 3:
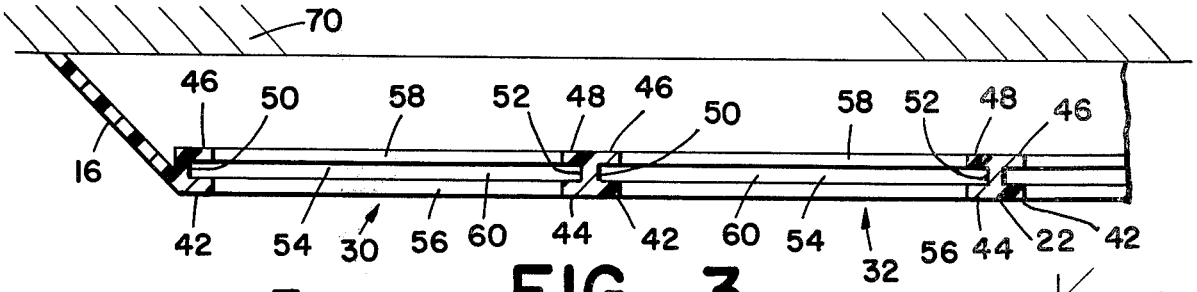
FIG. 3 is an enlarged cross-sectional view of the picture frame apparatus of FIG. 1 taken along the line III—III.
Figure 2:
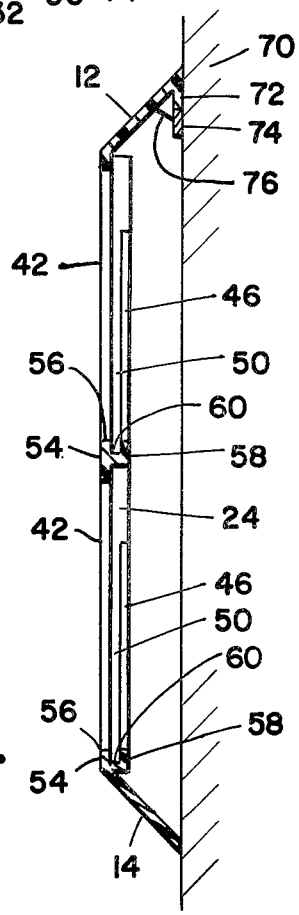
FIG. 2 is a cross sectional view of the picture frame apparatus of FIG. 1 taken along the line II—II.

As shown more clearly in the cross-sectional views of FIG. 2 and FIG. 3, associated with each window opening is an elongated slot-defining means formed in said struts whereby a card or the like may be seated therein to thereby position a card or the like in each window opening. Specifically, as shown in FIG. 3, each window opening includes two opposite front flange portions 42, 44. The flange portions 42, 44 are oriented to face one with the other in a common plane, with each positioned one on either side of each said window opening. FIG. 3 illustrates window openings 30 and 32, with the arrows associated therewith indicating the direction of viewing. Note that these said flange portions 42, 44 define the left and right edges of each window opening. The apparatus further includes two opposite rear flange portions 46, 48, similarly arranged to the front flange portions 42, 44, with a respective rear flange 46, 48 being along each side of each window opening and oriented to face one with the other in a common plane. Note that the rear flange portions 46, 48 are positioned in parallel with and behind the opposite front flange portions 42, 44. As can be seen, the resultant structure defines thereby for each window opening a pair of elongated slots 50, 52, with one along either side of the window opening.

Finally, to prevent a card or the like which has been inserted into said elongated slots 50, 52, from exiting through the bottom of the slots 50, 52, i.e. to ensure that the card or the like is properly positioned in said window opening, a base means 54 is provided to act as a stop for the card or the like. As is seen more clearly in FIG. 2, the base means 54 also defines the bottom edge of each said window opening. In the present embodiment, the base means 54 comprises first and second base flange portions 56, 58. These flange portions 56, 58 are oriented in an upward direction and aligned parallel one with the other such that an elongated bottom slot 60 is defined therebetween. To ensure that the card or the like fits properly within both the elongated slots 50, 52, along the side of each window opening, and also within slot 60 at the bottom of each window opening, the first base flange portion 56 is aligned in the same vertical plane as the front flange portion 42, 44 such that said flanges join in common at the bottom front corners of each window opening. Similarly, the second base flange portion 53 is aligned in the same vertical plane as the rear flange portions 46, 48 such that these flanges also join in common at the bottom rear corners of each window opening.

One of the features of the present invention is that cards or the like can be removed and replaced easily and simply from any desired window opening. Further, this feature is designed to be accomplished without sacrificing the sturdiness of the apparatus. In this regard, the rear flanges 46, 48 are sized such that a card or the like can be slipped into the elongated slots 50, 52 without impediment from the flange structures of adjoining window openings. In the preferred embodiment, the rear flanges 46, 48 are constructed such that they extend from the base 54 up to a slightly lesser height than the top of the given window opening, and corresponding flange portions 42, 44. Thus when a card is desired to be inserted into the slot, it is enabled to clear the rear flanges and abut against the top part of the front flanges 42, 44 after which it then can be slipped down the elongated slots 50, 52 until it comes in contact with the base means 54. Obviously, the removal of a given card from a window opening is similarly enabled.

Note that as most easily seen in FIGS. 2 and 3, the frame portion 10 is shaped such that the outer edges of said frame portion 10 are the only parts of the frame portion 10 and associated struts that comes in contact with the wall or other structure, shown in cross-section at 70, to which the frame apparatus is affixed. In the preferred embodiment, the window openings lie a fixed distance off of said wall or other structure 70 when the frame apparatus is affixed thereto. This is provided to aid in the secure mounting of the picture frame apparatus on the wall 70, and to provide room for said elongated slots. The frame portion 10 extends away from said wall or other structure 70 as the distance along the edge struts to said window openings gets smaller. As is seen in FIGS. 2 and 3, the frame portion 10, i.e. the top and bottom struts 12, 14 and side struts 16, 18, extend away from said wall 70 at a fixed angle when the frame portion is affixed to said wall 70, with only the outer perimeter of each said edge strut abutting the wall 70 surface.

As shown in FIG. 2, to provide a simple yet sturdy means for affixing the frame portion 10 to the wall 70, a hanger means is provided. The hanger means of the preferred embodiment includes a top edge flange 72 formed on said top edge strut 12. Secondly, a second unitary piece of molded plastic is provided and formed in the shape of a mounting plate means 74 and attached hook means 76. The mounting plate means 74 is designed to have lesser length than the distance between side struts 16 and 18 of said frame portion 10 to ensure that said frame portion 10 lies flush against said wall 70.

Figure 4:
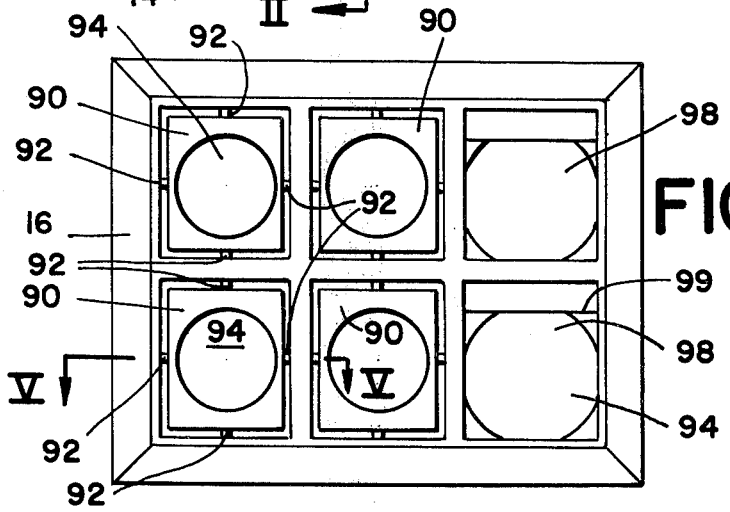
FIG. 4 illustrates the front view of the improved combination tray and picture frame apparatus including various types of inserts defined in each window opening.

FIG. 4 illustrates the front view of the improved combination tray and picture frame apparatus. FIG. 4 illustrates how each insert 90 or 98 may be positioned within a given window opening in the picture frame apparatus of the present invention. One embodiment, shown as inserts 90, are held in place by means of a plurality of nipples 92. A nipple may be positioned to interconnect each edge of an insert 90 with the adjacent window edge. Thus, for example, one nipple 92 would connect an insert 90 with vertical strut 24. A second nipple 92 would connect the insert 90 with side strut 16. The other two nipples would be similarly placed.

In the insert 90 embodiment shown in FIG. 4, four nipples 92 are used to secure each insert to the picture frame apparatus. However, only two nipples 92 may be required, depending on the size and consequent strength of each nipple. These may be placed on opposite sides of the insert, or as desired. Another alternate configuration would be to have four nipples 92, two each on each side of the insert 90, to secure the insert 90 thereby in the given window opening. Other similar means for removably attaching an insert to the picture frame apparatus are also envisioned as being within the scope of the present invention.

Alternate inserts 98 are also shown in FIG. 4. These inserts 98 are permanently attached to the picture frame apparatus, i.e. they are designed to be non-removable. In this embodiment, the two sides of an insert 98 are formed as part of the rear flange portions 46, 48 and the base of the insert 98 are formed as part of the base flange portion 58. To ensure the unobstructed placement of cards or the like from the rear of the picture frame apparatus into the elongated slots defined for each window opening formed by the various flange portions described above, the top edge 99 of the insert 98 is shaped such that it has a height corresponding to the height of said rear flange portions 46, 48.

Figure 5:
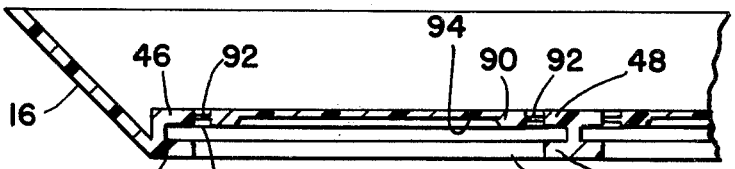
FIG. 5 is an enlarged cross sectional view of an insert taken along the line V—V of FIG. 4.

An enlarged cross-sectional view of an insert 90, taken along the line V—V of FIG. 4 is shown in FIG. 5. As is seen, the insert 90 is attached to adjacent struts 46, 48 by means of nipples 92. In the preferred embodiment, the insert 90 is attached to rear flange portions 46, 48 of the picture frame apparatus. This is so that when the inserts are removed, the portions of the nipples 92 which may be remaining on the flange portion will be invisible from the front of the picture frame when a card or the like has been inserted into the elongated slots defined in each said window opening.

In certain situations, however, it may be desirable to affix the insert to front flange portions 42, 44. This embodiment is illustrated in cross-section in FIG. 7. Note that if the insert is oriented such that a cup or the like when placed on the insert would extend past flanges 46, 48, some means should be provided to prevent scratching of the front surface of the picture frame apparatus during such use. Such scratching would normally result because the front of the frame would be acting as the bottom of the tray for the cups. Thus, a bump or raised portion 100 may be formed on the face of each insert 90, as shown, to prevent contact between the frame 10 and the surface on which it is placed, to thereby prevent such scratching of the frame front.

Both FIG. 4 and FIG. 5 indicate a depression 94 defined in each insert 90 or 98. This depression 94 is designed to fit the bottom of a coffee cup, soft drink cup, or the like, to provide a stabilizing means therefore, and to catch any minor spillage of fluid from such a cup when the present invention is being used as a tray. Note that the depression 94 can be of any convenient shape. For example, the depression 94 associated with inserts 98 in FIG. 4 are of a larger diameter than those defined in inserts 90.

Figure 7:
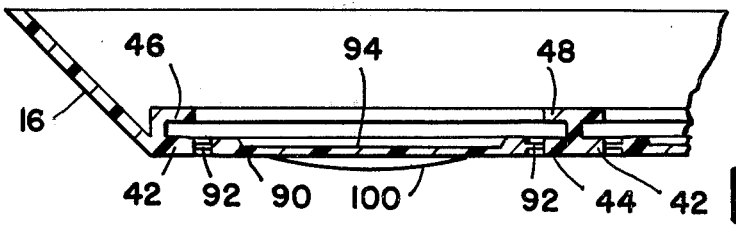
FIG. 7 is an enlarged cross sectional view of a second alternate embodiment of an insert and picture frame portion according to the present invention.

In FIG. 5, the depression 94 is defined such that the cup or the like placed therein would extend out from the front of the tray/picture frame apparatus. Alternatively, this depression 94 may be formed on the opposite side of the insert 90, 98, as illustrated in FIG. 7. Thus, a cup placed in this depression 94 would extend out from the rear of the picture frame apparatus.

Figure 6:
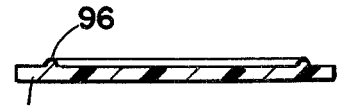
FIG. 6 is an enlarged crosss sectional view of an alternate embodiment of an insert according to the present invention.

An alternate embodiment of the insert 90 or 98 is illustrated in FIG. 6. In this embodiment, instead of a depression 94, a raised annular edge portion 96 is formed on the insert. This again provides a means for stabilizing the cup or the like during use of the present invention as a tray, and also provides means for catching fluid that may spill from the cup.

Removal of an insert can be performed in a number of ways. The simplest would be to use a knife or other sharp edged instrument to cut through the nipples 92 securing the insert to associated struts in a given window opening of the picture frame apparatus. Other means known in the art for removably attaching plastic components to a body are also deemed to be within the scope of the present invention.

I claim:

1. A combination tray and picture frame apparatus comprising:

a frame portion including a top edge strut, a bottom edge strut, and first and second side edge struts;

strut means comprising at least one strut interconnecting two of said edge struts such that a plurality of window openings are defined in said frame portion thereby, said struts including elongated slot defining means positioned adjacent each said window opening such that a card, photograph, or the like may be seated therein, to thereby position the card or the like in said opening;

insert means including one or more rigid inserts defined to be of a size such that a beverage container or the like is supportable on each such insert; and means for affixing each insert to adjacent said struts in a given window opening, such that said window opening is substantially covered by said insert.

2. The apparatus of claim 1 wherein said elongated slot defining means comprises front and rear flange potions, and wherein said means for affixing each insert to adjacent struts in a given window opening comprises means for affixing each insert to adjacent rear flange portions on said adjacent struts.

3. The apparatus of claim 2 wherein each said insert is sized such that it doesn't extend higher in its given window opening than the corresponding rear flange portions it is attached to.

4. The apparatus of claim 1 wherein said means for affixing said inserts to said struts comprises a plurality of nipples, each said nipple being formed between said insert and an adjacent said strut, thereby enabling said inserts to be removable from said window openings.

5. The apparatus of claim 4 wherein said insert is rectangular in shape and wherein each edge of said insert is removably affixed to an adjacent said strut by means of one of said nipples.

6. The apparatus of claim 1 wherein each said insert is further defined to include a depression formed on one surface thereof such that a beverage container or the like may be seated in said depression to enable stable carrying of the beverage container or the like on said insert.

7. The apparatus of claim 6 wherein said depression is circular in shape.

8. The apparatus of claim 1 wherein each said insert is further defined to include an annular raised edge on one surface of said insert, such that a beverage container or the like may be seated therein to enable stable carrying of the beverage container or the like on said insert.

9. The apparatus of claim 1 wherein each said insert is further defined to include a raised portion on one surface of said insert operatively positioned to prevent the front surface of said frame portion from becoming scratched during use of said apparatus as a tray.

10. The apparatus of claim 1 wherein each said insert is further defined to include means for stabilizing a cup or the like when the beverage container is positioned on said insert.

* * * * *